US006227677B1

(12) United States Patent
Willis

(10) Patent No.: US 6,227,677 B1
(45) Date of Patent: May 8, 2001

(54) PORTABLE LIGHT

(76) Inventor: Mary M. Willis, 687 Hampden Pl., Pacific Palisades, CA (US) 90272

( * ) Notice: Subject to any disclaimer, the term of this patent is extended or adjusted under 35 U.S.C. 154(b) by 0 days.

(21) Appl. No.: 09/552,989

(22) Filed: Apr. 21, 2000

(51) Int. Cl.[7] ..... F21L 4/00

(52) U.S. Cl. ..... 362/196; 362/191; 362/200; 362/156

(58) Field of Search ..... 362/183, 190, 362/191, 196, 156, 200, 208, 202

(56) References Cited

U.S. PATENT DOCUMENTS

| | | | | |
|---|---|---|---|---|
| 2,611,573 | * | 9/1952 | Young | 362/156 |
| 4,074,122 | * | 2/1978 | Moore | 362/200 |
| 4,268,894 | | 5/1981 | Bartunek et al. . | |
| 4,321,657 | * | 3/1982 | Hoi | 362/200 |
| 4,432,043 | | 2/1984 | Yuen . | |
| 4,774,638 | | 9/1988 | Caires . | |
| 4,782,432 | * | 11/1988 | Coffman | 362/183 |
| 4,881,155 | * | 11/1989 | Gahagan | 362/191 |
| 4,954,934 | | 9/1990 | Kidder et al. . | |
| 5,018,057 | | 5/1991 | Biggs et al. . | |
| 5,347,440 | | 9/1994 | Roberts et al. . | |
| 5,424,926 | | 6/1995 | Myers . | |
| 5,764,132 | | 6/1998 | Hill . | |
| 5,934,790 | | 8/1999 | Quintana et al. . | |

OTHER PUBLICATIONS

JKL Components Corporation, "JKL Miniature Fluorescent Lamps" (1999).

* cited by examiner

*Primary Examiner*—Y. Quach
(74) *Attorney, Agent, or Firm*—Sanford Astor

(57) ABSTRACT

A small, hand-held, battery-operated portable light which provides substantial lighting by the use of a fluorescent cold cathode lamp. The light has a flat surface so that it may be placed on a flat work surface and does not have to be held by the user. It also comprises means to hang the light, such as on a nail or around the user's neck. The light is adapted to be attached to the inside of a purse, briefcase or other container. It is powered by standard or rechargable batteries.

14 Claims, 5 Drawing Sheets

PORTABLE LIGHT

BACKGROUND OF THE INVENTION

The use of portable lighting devices is known in the prior art. For instance, there have been a number of patents issued for lights adapted to be used inside of a women's purse. These include U.S. Pat. Nos. 5,424,926; 4,774,638 and 5,934,790. There are also patents for portable lights including U.S. Pat. No. 5,347,440, as well as patents utilizing fluorescent lighting such as U.S. Pat. Nos. 4,268,894 and 4,432,043.

The purse lights are not adequate for the job for which they are intended because they all use a small light bulb which simply does not provide enough light and the light is focused in one small spot where the bulb is located. The fluorescent lighting devices cannot be used for personal or purse use because they are all too large to fit in one's pocket or purse.

SUMMARY OF THE INVENTION

Applicant's invention comprises a small, portable, hand-held, battery-operated light which provides the broad lighting of a fluorescent light, but is considerably brighter, yet has the small size previously only attainable with a light bulb. Applicant's lighting device is adapted to stand on its own, on a flat surface, so that it does not have to be held, freeing the user's hands. It may be hung on a hook or hung around the user's neck, with a neck strap, or it may be removeably attached inside of a purse, briefcase or other container. It is small enough that it may be carried in a pocket and taken to places it is needed such as a dark restaurant or work area.

Applicant accomplishes these results by the use of a fluorescent cold cathode lamp which provides a remarkable amount of light for its size, allowing the device to be made quite small and yet provide very effective lighting. In addition, it may use rechargable batteries so that periodic battery replacemant is unnecessary.

OBJECTS OF THE INVENTION

Accordingly, several objects and advantages of the invention are as follows:

It is an object of the present invention to provide a small, portable lighting device which provides considerable light and yet is small in size.

Another object of the invention is to provide such a device which may stand on a flat surface so that the user's hands are free.

Yet another object of the invention is to provide such a device which may be removeably attached in a purse, briefcase or other container.

DETAILED DESCRIPTION OF THE INVENTION

Figure 1:
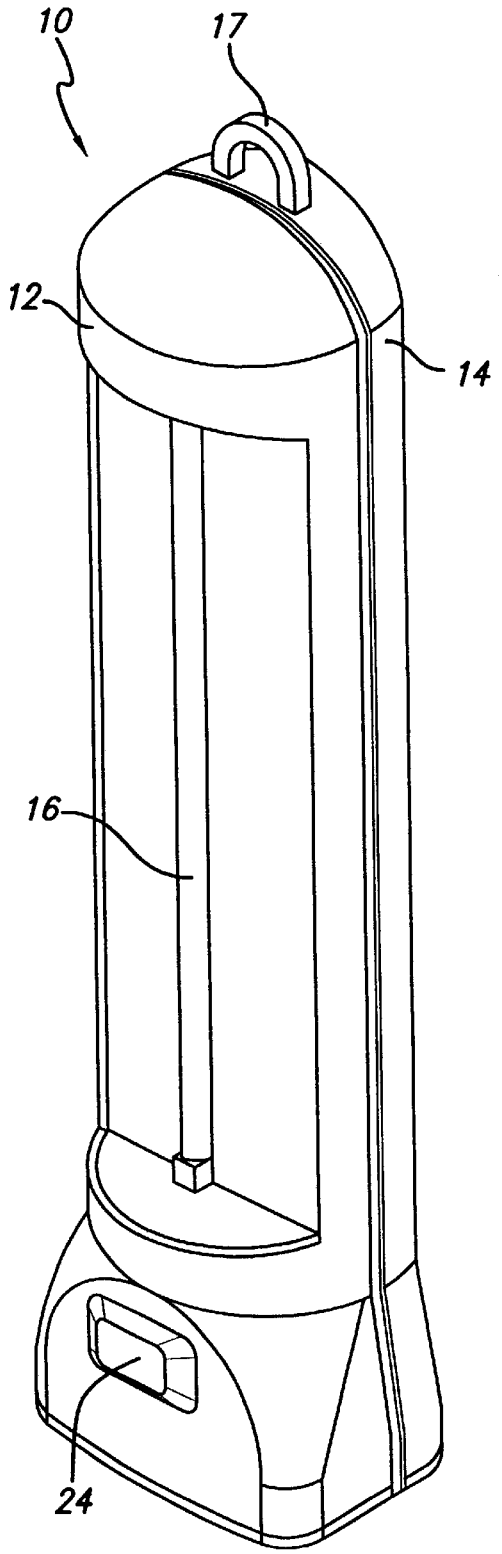
FIG. 1 is a perspective view of the lighting device of this invention from the top.
Figure 2:
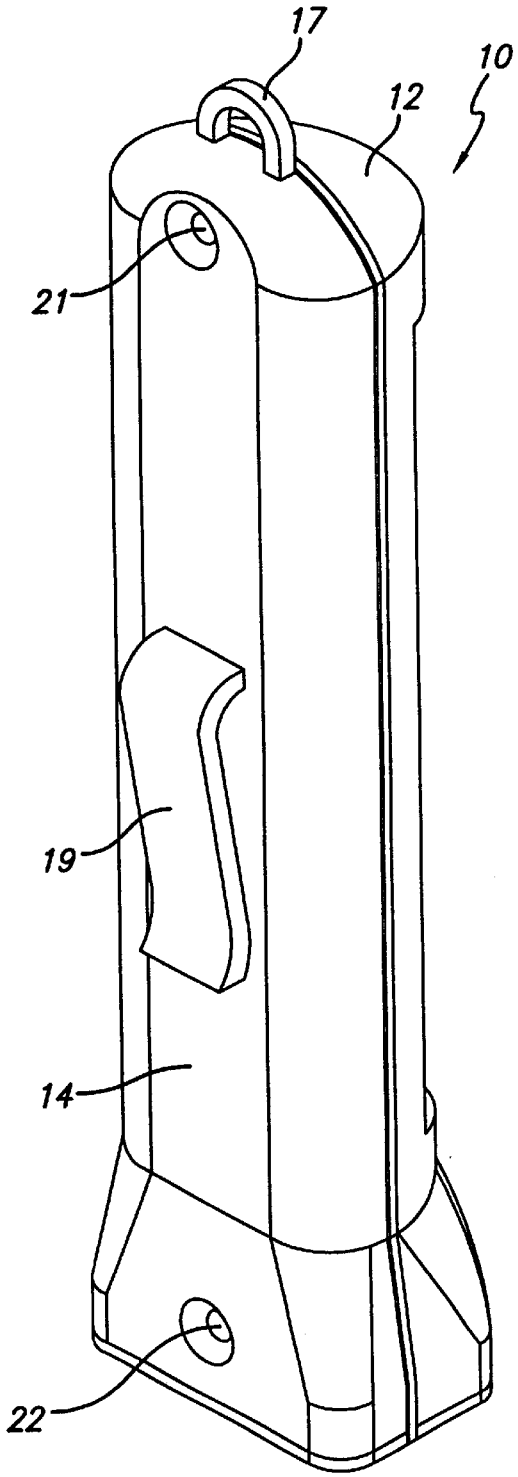
FIG. 2 is a perspective view from the bottom.
Figure 3:
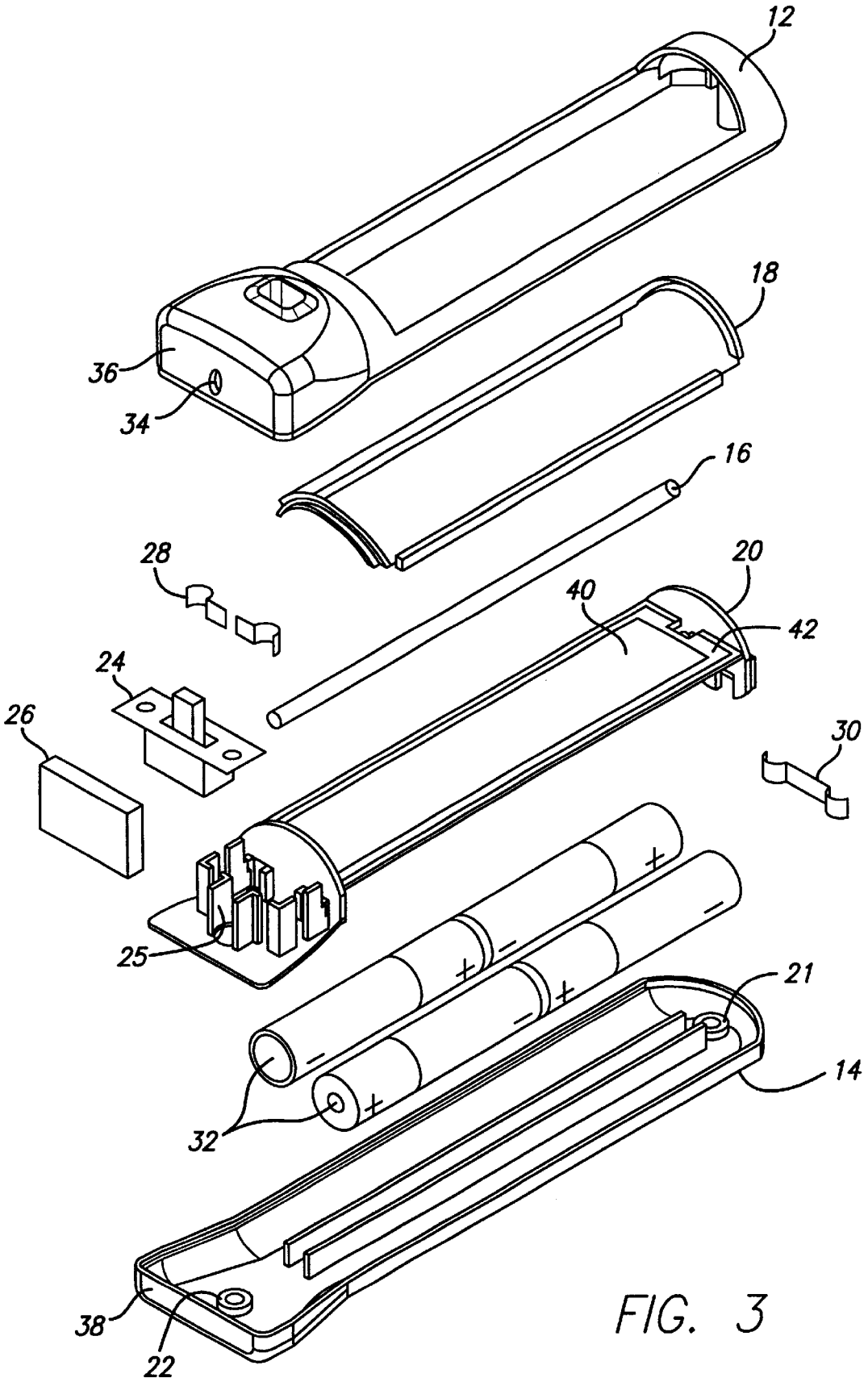
FIG. 3 is a top exploded view.
Figure 4:
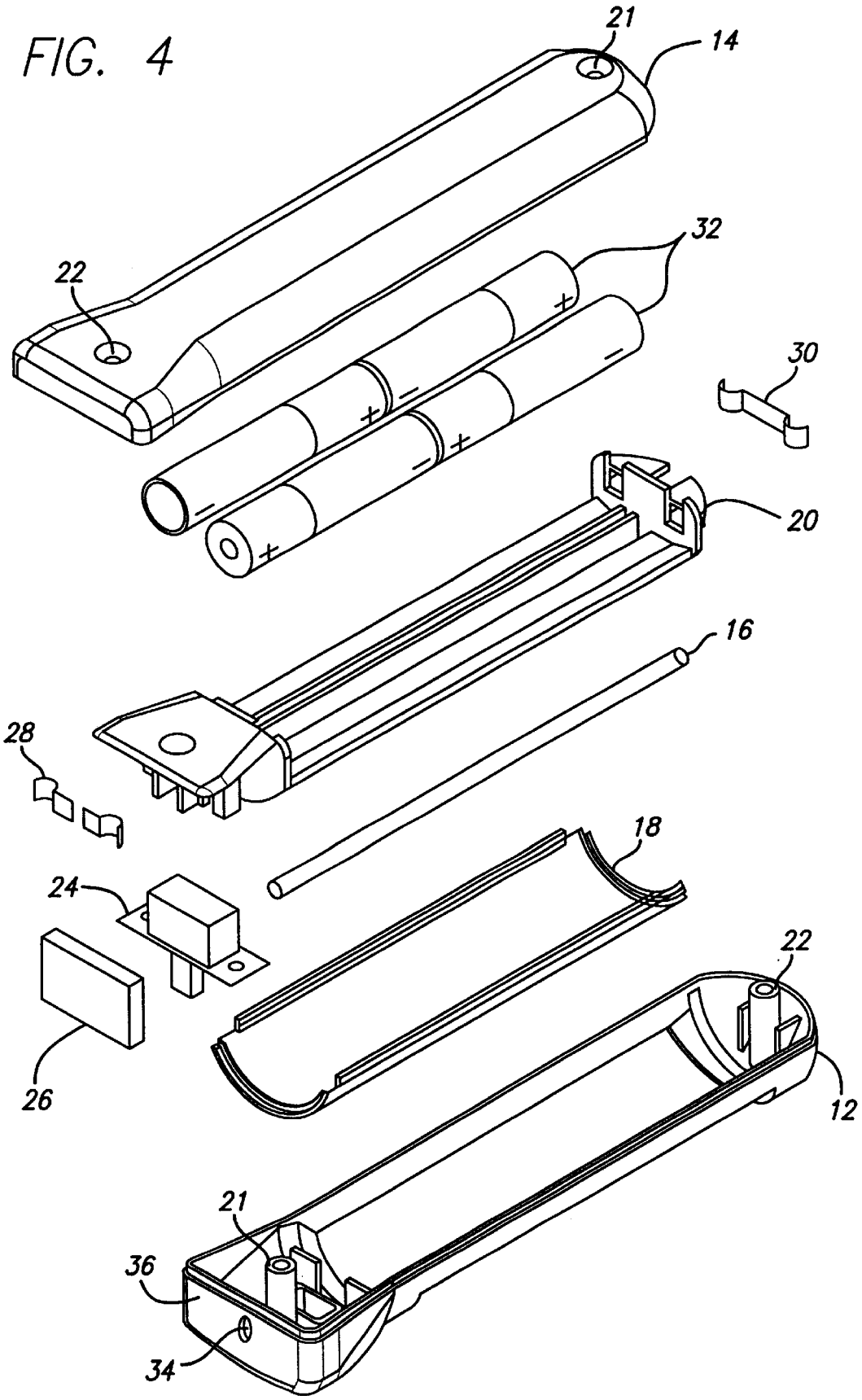
FIG. 4 is a bottom exploded view.
Figure 5:
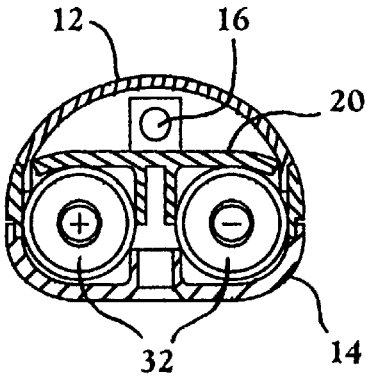
FIG. 5 is a cross-section taken on lines 5—5 of FIG. 8.
Figure 6:
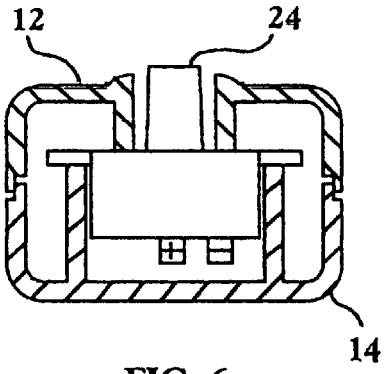
FIG. 6 is a cross-section taken on lines 6—6 of FIG. 8.
Figure 7:
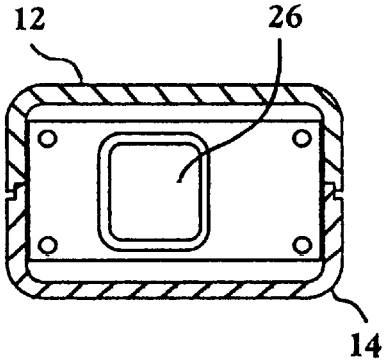
FIG. 7 is a cross-section taken on lines 7—7 of FIG. 8.
Figure 8:
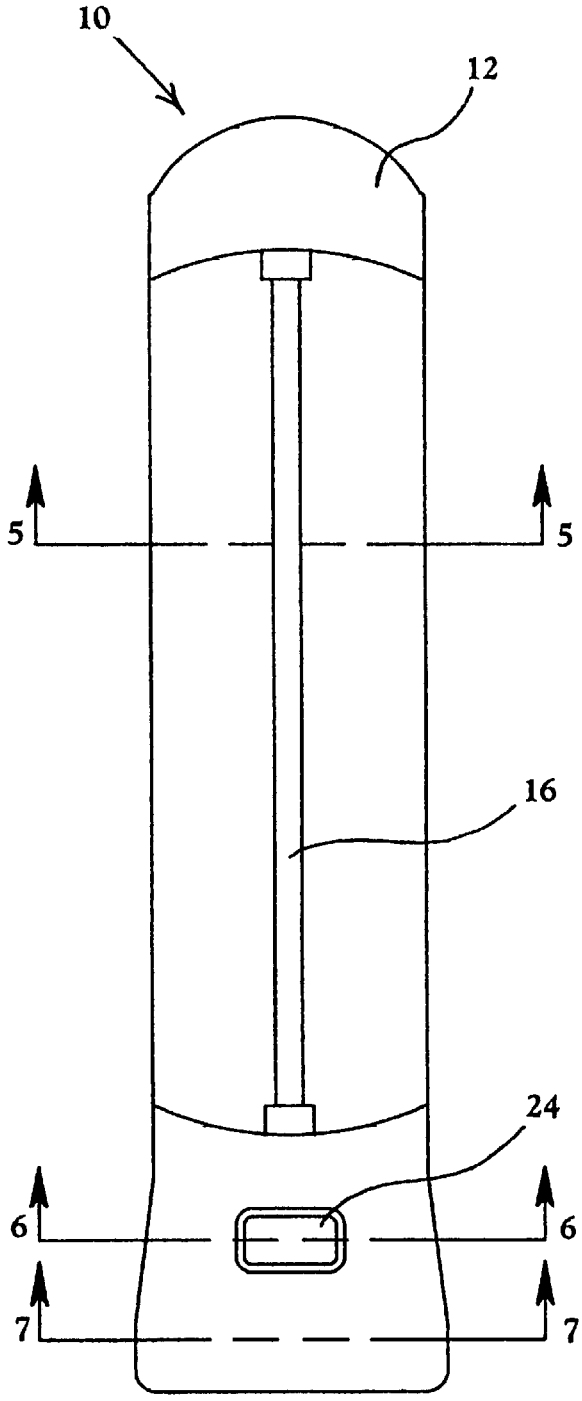
FIG. 8 is a front view.
Figure 9:
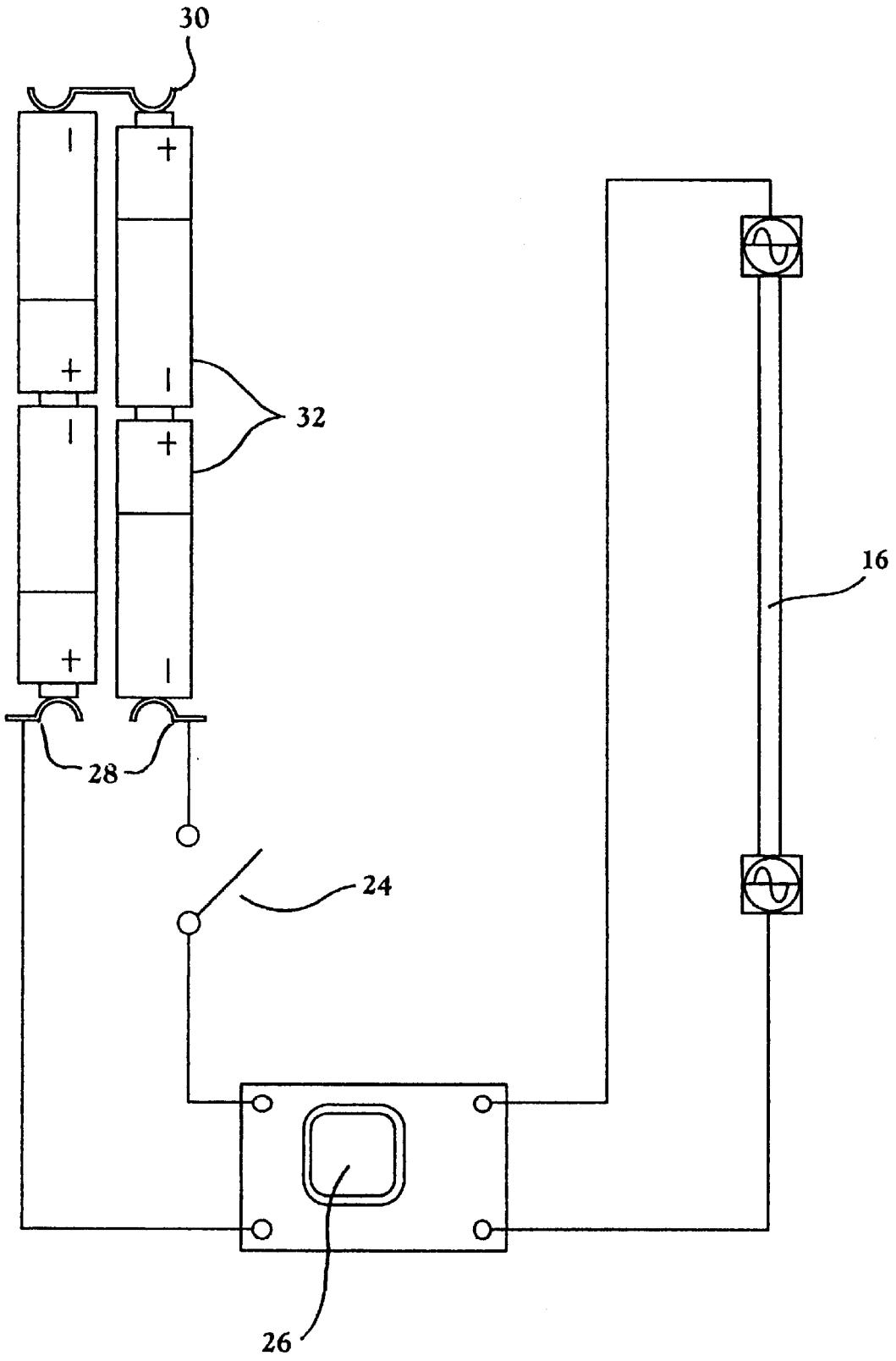
FIG. 9 is an electrical diagrammatic view.

Referring now to the drawings, there is shown the lighting device 10 of this invention. The device comprises a housing having an elongated bezel or front cover 12 and an elongated rear cover 14. A cold cathode mini-fluorescent lamp 16 is held under lens 18 which is a plastic or glass cover for lamp 16. Rear cover 14 optionally comprises an eyelet 17 and/or a belt-clip 19.

Chassis 20 fits between bezel 12 and rear cover 14. Chassis 20 comprises an inverter 26 which is needed to operate cold cathode lamp 16, and switch 24 for turning the light on and off. Framework 25 of chassis 20 holds inverter 26, switch 24 and contacts 28. Front cover 12, rear cover 14 and chassis 20 are held together by connectors, such as screws, which fit through connector holes 21 and 22.

Lower contacts 28 and upper contacts 30 provide the electrical connection between the batteries 32 and inverter 26 to operate lamp 16. As shown, the device operates on four standard AAA batteries, however these batteries may be replaced by a rechargable battery, such as a 6 volt rechargeable battery, which can be recharged through recharge port 34 using a standard 110 volt recharger, such as are used for common appliances.

A cold cathode, mini-fluorescent lamp which is ideally used for this device is one manufactured by JKL Components Corporation of Pacoima, Calif. Cold cathode lamps are relatively efficient compared to light sources such as incandescent lamps. Cold cathode lamps convert about 20% of applied electrical energy into usable photopic light in the 380 to 780 nanometer range. The cold cathode lamp withstands shock and vibration very well and provides exceptional light output from a low-profile footprint. The cold cathode lamp emits no heat, which is a great asset when the portable light of this invention is used inside of a purse, briefcase or other bag and also when it is worn around the neck or in the pocket of the user.

The preferred embodiment of this invention utilizes a mini-fluorescent cold cathode lamp which is 3 mm in diameter and only 86 mm long. This lamp has an intensity of 28,000 Cd./$m^2$ (Candelas per meter squared) or about 40 lumens, with an expected life of 20,000 hours. The inverter used with this lamp is a single output 5 VDC (volt direct current) input inverter, which has an expected life of 380,000 hours.

Because lamp 16 is only 86 mm long, the portable light of this invention is only 4½ inches long and is only 1 inch wide. It thus provides considerable light for the user, over a broad area, even though it is quite small.

Bezel 12 has a flat base 36. Rear cover 14 also has a flat base 38. When assembled, the light may be set, and will stand, on its base 36, 38 so that the user may have his or her hands free. Eyelet 17 at the top of the light may be used to hang the light, such as on a nail, or a neck strap or string may be passed through eyelet 17 so that the device may be hung around the user's neck, also leaving the user's hands free. A belt clip 19 may also be added to hold the light on a belt, or on a shirt pocket, while the light is on and being used. All of these provide methods to use the light without having to hold it in one's hands. Including the four AAA batteries, the portable light weighs only about 2 ounces, only about 1 ounce without the batteries.

The light is adaptable to be removeably attached inside of a purse, briefcase or other container. This can be done in a number of ways, the easiest of which is to utilize a self-adhesive hook and loop fastener, such as STICKYBACK® VELCRO®, one portion of which is attached inside of the container and the other portion of which is attached to the back cover 14 of light 10. Another possible method of attachment comprises a plurality of elastic loops sewn into the interior of the purse or briefcase, under which light 10 is passed and held.

Reflector means 40, such as reflector tape, may be placed under cold cathode lamp 16 and fixed to the flat surface 42 of chassis 20. This intensifies the light of the lamp 16. Reflector tape is commercially available, such as aluminum foil tape with an adhesive backing, manufactured by McMaster-Carr Co. of Sante Fe Springs, Calif.

In use, its size and weight make the light an extremely portable instrument. The flat surface 36, 38 enables the light to stand at a specific area for hands free illumination. If a person desires the light to be readily accessible, it may be attached to a string to be worn around the neck, or clipped to a pocket or belt. For frequent usage, the light, when using rechargeable batteries, may be accompanied by a recharger unit. The light works with 4 AAA batteries which are light weight and easily accessible. The inverter is a single output 5 VDC input. When attached in a purse, bag or briefcase, the entire contents of the bag will be illuminated.

This portable light has many uses due to its size, weight and adaptability for manners of use. Some of these uses include the following:

Auto mechanics, for extra light while working under a car.

Emergency lighting which is more portable, emits more light and is brighter than a flashlight's beam of light.

Light for nighttime outdoor activity, such as camping.

Light inside a car, such as for a convertible, or other cars, which don't have a "dome" light.

Light when walking to a car in dark parking lot.

Light when trying to read a menu in dimly lit restaurants.

Nighttime reading where there is no access to other lighting.

The portable light of this invention is far superior to a flashlight because it is brighter, easier to hold/hang/hook, emits a greater spectrum of light and will illuminate a room when set on a flat surface. It has a greater area of light, not just a beam of light. If a person has a choice in their portable light needs, it would make sense to choose a light which is everything a flashlight is not.

This light is especially useful for every woman who rummages through her purse trying to find something, is nervous walking to her car at night, or wants to light a darkened room.

It is also useful for everyone who wants to know that they have emergency lighting in case of an earthquake, hurricane, or other cause of loss of electricity. Because of its portability and the amount of light it provides, this light will find many other uses not specifically mentioned.

Having thus described the invention,

I claim:

1. A small, battery operated portable light comprising a housing having an elongated front cover, which connects to an elongated rear cover, each of the front cover and rear cover having a flat base at one elongated end, so that the housing can stand on the flat base of the elongated end of the front and rear cover a chassis held between the front cover and the rear cover, a mini-fluorescent cold cathode lamp held in the chassis, a lens held in the front cover covering the lamp, an inverter held in the chassis electrically connected to the lamp, an on-off switch held in the chassis electrically connected to the inverter and one battery or more batteries electrically connected to the inverter.

2. The light of claim 1 further comprising an eyelet fixedly attached to an elongated end of the housing.

3. The light of claim 1 further comprising a belt clip fixedly attached to the housing.

4. The light of claim 1 in which the battery or batteries are rechargeable.

5. A small, battery operated portable purse light comprising a housing having an elongated front cover, which connects to an elongated rear cover, each of the front cover and the rear cover having a flat base at one elongated end, so that the housing can stand on the flat base of the elongated end of the front and rear cover a chassis held between the front cover and the rear cover, a mini-fluorescent cold cathode lamp held in the chassis, a lens held in the front cover covering the lamp, an inverter held in the chassis electrically connected to the lamp, an on-off switch held in the chassis electrically connected to the inverter, one battery or more batteries electrically connected to the inverter and means to removably attach the light to the interior of a purse.

6. The light of claim 5 in which the means to attach the purse light comprises a self-adhesive hook and loop fastener.

7. The light of claim 5 in which the means to attach the purse light comprises a plurality of elastic loops.

8. The light of claim 5 further comprising an eyelet fixedly attached to an elongated end of the housing.

9. The light of claim 5 further comprising a belt clip fixedly attached to the housing.

10. The light of claims 1 or 5 in which the mini-fluorescent cold cathode lamp is about 86 millimeters long.

11. The light of claims 1 or 5 in which the light is about 4½ inches long and about 1 inch wide.

12. The light of claim 5 further comprising reflector tape affixed to the chassis under the lamp.

13. The light of claim 1 further comprising reflector tape affixed to the chassis under the lamp.

14. The light of claims 13 or 12 in which the reflector tape is aluminum foil having an adhesive backing.

* * * * *